US011065553B2

(12) United States Patent
Blum et al.

(10) Patent No.: US 11,065,553 B2
(45) Date of Patent: Jul. 20, 2021

(54) SYSTEMS AND METHODS FOR SECURING A MOVABLE ARM OF A RIDE VEHICLE

(71) Applicant: Universal City Studios LLC, Universal City, CA (US)

(72) Inventors: Steven C. Blum, Orlando, FL (US); David Majdali, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 326 days.

(21) Appl. No.: 16/024,185

(22) Filed: Jun. 29, 2018

(65) Prior Publication Data

US 2019/0351341 A1 Nov. 21, 2019

Related U.S. Application Data

(60) Provisional application No. 62/673,486, filed on May 18, 2018.

(51) Int. Cl.
*A63G 31/02* (2006.01)

(52) U.S. Cl.
CPC ..... *A63G 31/02* (2013.01)

(58) Field of Classification Search
CPC ..... A63G 21/06; A63G 21/08; A63G 31/02; A63G 31/16; A63G 7/00; A63G 1/30; A63G 1/24; A63G 27/02; A63G 31/04; A63G 23/00; A63G 1/28; A63G 1/34; B25J 5/02; B60R 2021/0097; B66F 11/044

See application file for complete search history.

(56) References Cited

U.S. PATENT DOCUMENTS

| | | | | |
|---|---|---|---|---|
| 5,527,221 | A | 6/1996 | Brown et al. | |
| 5,813,350 | A * | 9/1998 | Ochi | A63G 7/00 104/54 |
| 6,253,502 | B1 * | 7/2001 | Layton | H01Q 1/3216 212/180 |
| 6,776,722 | B2 | 8/2004 | De-Gol | |
| 9,162,150 | B2 | 10/2015 | Roodenburg et al. | |
| 9,751,022 | B1 | 9/2017 | Fram | |
| 2003/0172834 | A1 | 9/2003 | De-Gol | |

(Continued)

FOREIGN PATENT DOCUMENTS

| | | |
|---|---|---|
| CN | 106621339 | 5/2017 |
| CN | 206240047 | 6/2017 |

(Continued)

OTHER PUBLICATIONS

PCT/US2019/020407 International Search Report and Written Opinion dated May 27, 2019.

*Primary Examiner* — Mark T Le
(74) *Attorney, Agent, or Firm* — Fletcher Yoder P.C.

(57) ABSTRACT

The ride vehicle system includes a ride vehicle having a ride vehicle base configured to interface with a ride track and move along the ride track. The ride vehicle also has a movable arm having a base end and a free end. The moveable arm moves along one or more motion-controlled axes. The movable arm is mounted to the ride vehicle at the base end. A ride seat is attached to the free end of the movable arm. A coupling device couples a first portion of the movable arm to the ride vehicle base, the ride seat to a second portion of the movable arm, the ride seat to the ride vehicle base, or some combination thereof.

21 Claims, 15 Drawing Sheets

(56) References Cited

U.S. PATENT DOCUMENTS

| | | | | |
|---|---|---|---|---|
| 2010/0280660 | A1* | 11/2010 | Hasenzahl | B25J 9/1664 700/253 |
| 2011/0029133 | A1* | 2/2011 | Okazaki | B25J 19/0004 700/258 |
| 2011/0060462 | A1 | 3/2011 | Aurnhammer et al. | |
| 2013/0108992 | A1* | 5/2013 | Buelthoff | G09B 9/02 434/33 |
| 2014/0358330 | A1 | 12/2014 | De-Gol | |
| 2015/0128824 | A1 | 5/2015 | Snyder et al. | |
| 2016/0220910 | A1 | 8/2016 | Zamperla | |
| 2016/0221192 | A1 | 8/2016 | Monreal et al. | |
| 2018/0297486 | A1* | 10/2018 | Howard | B60M 7/00 |
| 2020/0241535 | A1* | 7/2020 | De-Gol | G05D 1/0212 |

FOREIGN PATENT DOCUMENTS

| | | | |
|---|---|---|---|
| WO | WO 2012039601 | * | 3/2012 |
| WO | 16176908 | | 11/2016 |
| WO | 17144302 | | 8/2017 |
| WO | 17220199 | | 2/2018 |

* cited by examiner

SYSTEMS AND METHODS FOR SECURING A MOVABLE ARM OF A RIDE VEHICLE

CROSS-REFERENCE TO RELATED APPLICATIONS

The present application claims the benefit of U.S. Provisional Application No. 62/673,486, entitled "Systems and Methods for Securing a Movable Arm of a Ride Vehicle" and filed May 18, 2018, the disclosure of which is incorporated herein by reference for all purposes.

BACKGROUND

The present disclosure relates generally to the field of amusement parks. Specifically, embodiments of the present disclosure related to techniques to secure a movable arm of a ride vehicle of an attraction.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Since the early twentieth century, amusement parks have substantially grown in popularity. To maintain this growth in popularity, new amusement park attractions are designed to provide guests with unique motion and visual experiences. Certain amusement park attractions incorporate movable arms into ride vehicles to alter a traditional attraction experience by adding additional range of motion in the ride vehicles. However, components of these amusement park attractions may experience additional forces that are not present in a traditional attraction experience. These amusement park attractions rely on the movable arm to bear forces (e.g., static and dynamic loads) from the movable arm, the guests, and other forces present in the attraction. However, the additional forces may increase wear on components of the amusement park attraction (e.g., the ride vehicle or the movable arm). Increased wear on the components will likely shorten the life-span of the components, which will increase costs for amusement park attraction operators. Accordingly, it is now recognizable that it is desirable to improve these amusement park attractions.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a ride vehicle system is provided. The ride vehicle system has a ride vehicle. The ride vehicle includes a ride vehicle base configured to interface with a ride track. The ride vehicle base is configured to move along the ride track. The ride vehicle also has a movable arm with a base end and a free end. The movable arm is configured to move along one or more motion-controlled axes. The movable arm is mounted to the ride vehicle base at the base end, and the movable arm is configured to move with respect to the ride vehicle base. The ride vehicle system further has a ride seat attached to the free end of the movable arm and a coupling device configured to couple a first portion of the movable arm to the ride vehicle base, the ride seat to a second portion of the movable arm, the ride seat to the ride vehicle base, or a combination thereof.

In accordance with another embodiment, a ride vehicle is provided. The ride vehicle includes a ride vehicle base configured to interface with a ride track. The ride vehicle base is configured to move along the ride track. The ride vehicle also includes a movable arm with a base end and a free end. The movable arm is configured to move along one or more motion-controlled axes. The movable arm is mounted to the ride vehicle base at the base end, and the movable arm is configured to move with respect to the ride vehicle base in response to a movement signal from the ride vehicle controller. The ride vehicle also has a ride seat attached to the free end of the movable arm. Additionally, the ride vehicle has a locking device configured to actuate to a locked position to lock movement of the movable arm along at least one motion-controlled axis to restrain the free end of the movable arm.

In accordance with another embodiment, a method is provided. The method includes moving a movable arm of a ride vehicle, relative to a ride vehicle base, to a first configuration. The method further includes moving the movable arm from the first configuration to a second configuration when the ride vehicle is at or near a portion of a ride track configured to cause the ride vehicle to experience forces above a predetermined threshold when the movable arm is in the first configuration. At least a portion of the movable arm is closer to the ride vehicle base in the second configuration than in the first configuration.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Theme park or amusement park attractions have become increasingly popular, and various amusement park attractions have been created to provide passengers with unique motion and visual experiences. Certain amusement park attractions incorporate movable arms into ride vehicles to alter a traditional attraction experience by adding additional range of motion for the passengers. However, components of these amusement park attractions may experience additional forces and/or stresses that are not present during a traditional attraction experience. The additional forces and/or stresses may increase wear on components of the amusement park attraction (e.g., a ride vehicle or a movable arm). Securing the movable arm or positioning the movable arm in a configuration associated with less stress relative to a more extended configuration may reduce wear on the components caused by the additional forces and/or stresses. Further, the securing and/or positioning may occur in a selective manner triggered by portions of a ride associated with relatively higher forces and/or stresses. Accordingly, a free-end of the movable arm may engage in a wider range of motion during certain portions of a ride while being at least partially locked in position during faster or more thrilling parts of the same ride to distribute stresses from the movable arm.

Figure 1:
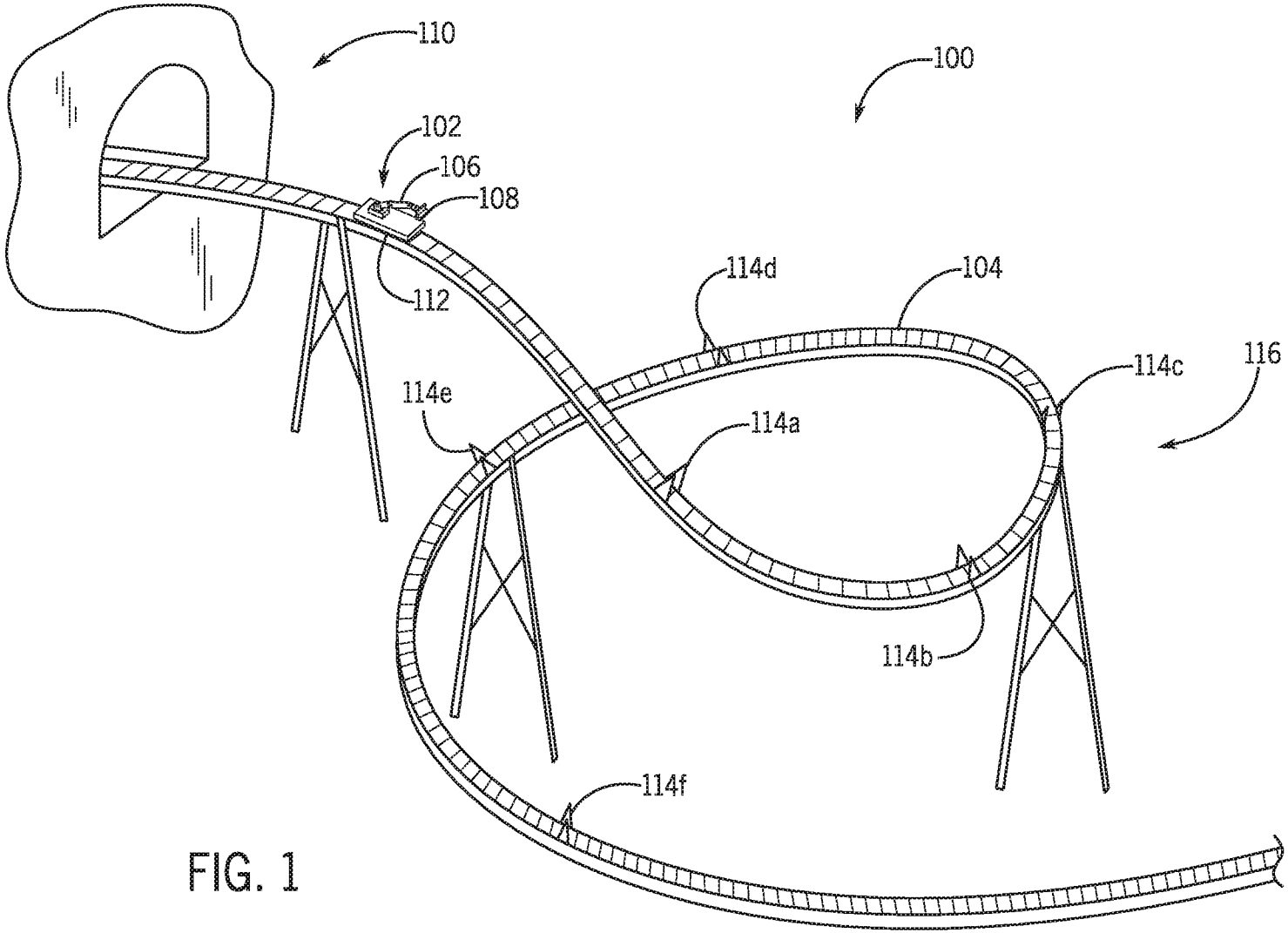
FIG. 1 is a perspective view of ride vehicle traveling along a ride track of an amusement park attraction in accordance with present techniques.

FIG. 1 is a perspective view of an amusement park attraction 100 (e.g., roller coaster) with a ride vehicle 102 traveling along a ride track 104 of the amusement park attraction 100 during a ride cycle. The ride vehicle 102 may include a movable arm 106 that is coupled to and that moves a ride seat 108 with respect to the ride vehicle 102 to create attraction events (e.g., ride sequences) for passengers of the ride vehicle 102. In some embodiments, the amusement park attraction 100 may create the attraction events using combinations of ride seat movements from moving the movable arm 106 and ride conditions encountered along the ride track 104. The ride conditions may be related to a shape of the ride track 104, which may include curves, loops, or twists in the ride track or may be related to motion of the ride vehicle 102 on the ride track 104, e.g., speed, velocity, acceleration, deceleration, or changes in direction experienced by the ride vehicle along the ride track. The amusement park attraction 100 may augment the attraction events with an environment 110 surrounding the ride track 104. For example, in the depicted embodiment the ride track 104 of the amusement park attraction 100 is indoors (e.g., a dark ride). However, in other embodiments, the ride track 104 may travel through an outdoor environment or a hybrid environment (e.g., indoor and outdoor environment).

The ride vehicle 102 may move along the ride track 104 using a friction wheel assembly 112. However, in other embodiments, the ride vehicle 102 may move along the ride track 104 using any suitable propulsion or interface assembly. As the ride vehicle 102 moves along the ride track 104, position indicators 114*a*, 114*b*, 114*c*, 114*d*, 114*e*, and 114*f* may detect the ride vehicle. In response to detecting the ride vehicle, the position indicators 114 may output a ride condition signal. In some embodiments, the position indicators 114 may constantly output the ride condition signal using a short range frequency, which may be received by a transceiver disposed on the ride vehicle 102 when the ride vehicle is in range of one of the position indicators 114.

The position indicators 114 may be disposed at regular intervals along the ride track 104. However, in some embodiments, the position indicators 114 are positioned proximate to a track feature 116. The track feature 116 may include one of the ride conditions in the ride track (e.g., curves, loops, or twists) or a portion of the ride track where the ride vehicle will experience one of the ride conditions (e.g., acceleration, deceleration, or changes in direction). For example, a first position indicator 114*a* may be placed at a determined distance in front of a track feature (e.g., curve) in the ride track 104. As the ride vehicle 102 passed the first position indicator 114*a*, the first position indicator outputs a first ride condition signal to indicate that the track feature 116 is located at the predetermined distance from the ride vehicle 102. Using information provided by the first ride condition signal, the ride vehicle 102 may secure (e.g., re-position, couple, or lock) the movable arm 106 in anticipation of the track feature 116 in the ride track. In some embodiments, the ride vehicle 102 may secure a free-end of the movable arm 106 in anticipation of the track feature 116 in the ride track. Further, a second position indicator 114*b* may be placed at a location where the curve ends. As the ride vehicle exits the curve of the track feature 116 and passes the second position indicator 114*b*, the second position indicator 114*b* may output a second ride condition signal indicating that the track feature 116 ended and the ride vehicle may release the movable arm 106. While the position indicators 114 may be coupled to or disposed along the track as shown in FIG. 1, the vehicle position information used to generate a ride condition signal may be generated using other indicators of a ride vehicle position. For example, the ride vehicle 102 may have a position sensor that communicates wirelessly with a ride controller, and the ride vehicle position may be determined based on the wireless communication. The ride vehicle position relative to one or more track features 116 may also be estimated based at least in part on a time of an attraction clock.

Figure 2:
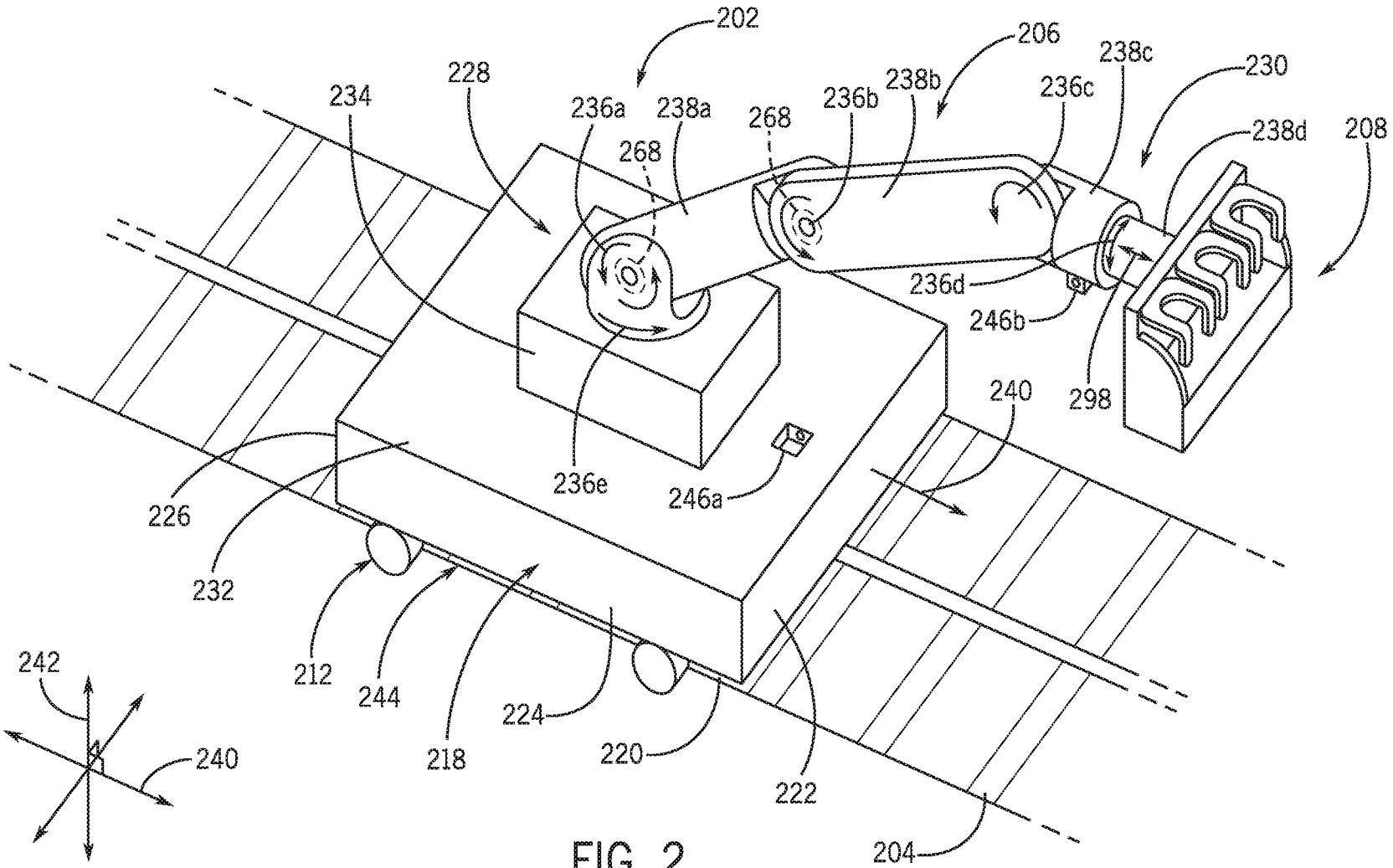
FIG. 2 is a perspective view of the ride vehicle comprising a movable arm in accordance with present techniques.

FIG. 2 is a perspective view of an embodiment of a ride vehicle 202 having a movable arm 206. The ride vehicle 202 has a ride vehicle base 218 configured to interface with a ride track 204 via a friction wheel assembly 212 or a similar assembly. The friction wheel assembly 212 may be coupled to a bottom portion 220 of the ride vehicle base. However, in some embodiments, the friction wheel assembly 212 is coupled to a front portion 222, side portion 224, or back portion 226 of the ride vehicle base.

In some embodiments, the movable arm 206 has a base end 228 and a free end 230. The ride seat 208 for carrying passengers may be attached to or otherwise coupled to the free end 230 of the movable arm 206. In the depicted embodiment, the ride seat 208 is permanently attached to the movable arm 206. In some embodiments, the ride seat 208 is detachably coupled to the movable arm such that the ride seat may be disconnected from the movable arm for maintenance. However, the ride seat may be, in certain embodiments, detachably coupled to the movable arm such that the ride seat may be disconnected from the movable arm during part of the amusement park attraction. The ride seat 208 may comprise a separate friction wheel assembly or other suitable assembly for travelling along the ride track 204 or another track of the amusement park attraction. In such an embodiment, hydraulic, electric, or pneumatic actuators may be configured to couple and de-couple the ride seat 208 and the movable arm 206.

The base end 228 of the movable arm may be mounted directly to the ride vehicle base 218, e.g., mounted to a top portion 232 of the ride vehicle base or any other exterior surface. In another embodiment, the movable arm 206 may be mounted to the ride vehicle base via a mounting unit 234 configured to form an interface between the ride vehicle base 218 and the movable arm 206. The mounting unit 234 may be configured to statically increase a height of the movable arm 206 with respect to the ride vehicle base 218 so the movable arm can raise the ride seat 208 a greater height or extend the ride seat 208 a greater distance. In other embodiments, the mounting unit 234 may be configured to facilitate or fortify the attachment between the ride vehicle base 218 and the movable arm 206.

The movable arm 206 is configured to move with respect to the ride vehicle base 218. For example, the movable arm 206 may move when the ride vehicle 202 is moving along the ride track 204 or is stationary. The movable arm 206 may move to augment an attraction event or to secure the movable arm for a certain track feature. The movable arm 206 may move along one or more motion-controlled axes 298. The movable arm 206 may rotate, extend, or retract along the one or more motion-controlled axes 298. That is, in certain embodiments, the movable arm 206 may be responsive to controller-based instructions to operate and move the movable arm along one or more axes in a motion-controlled manner. The movement may be open loop or closed loop (responsive to feedback). In some embodiments, the movable arm 206 may move with respect to the ride vehicle base 218 via rotation of a plurality of rotational joints 236*a*, 236*b*, 236*c*, 236*d*, and 236*e*. The movable arm 206 may have a plurality of arm segments 238*a*, 238*b*, 238*c*, and 238*d* connected via the plurality of rotational joints 236. One of the plurality of rotational joints 236*b* may rotate a pair of connected arm segments 238*a* and 238*b* of the plurality of arm segments 238 about an axis parallel to each axis of each segment of the pair of connected arm segments or about an axis perpendicular to each axis of each arm segment of the pair of connected arm segments. As depicted in the present embodiment, the movable arm 206, via the plurality of rotational joints 236, has six degrees of freedom with which it moves the free end 230 of the movable arm. However, in other embodiments, the movable arm 206 may have any number of degrees of freedom greater than or equal to four degrees of freedom. In some embodiments, the movable arm has six non-redundant degrees of freedom. In some embodiments, the movable arm may move with respect to the ride vehicle base via linear actuation (e.g., extension and retraction) of at least one of the plurality of arm segments. For example, arm segment 238*d* may be configured to extend and retract with respect to arm segment 238*c*.

In some embodiments, the movable arm 206 is configured to move in response to receiving a movable arm position signal. The movable arm position signal may have instructions for the movable arm 206 to move to a particular configuration, e.g., a configuration that includes the positions of various articulating portions of the movable arm 206. Accordingly, the movable arm position signal may involve instructions to cause movement of one or more portions of the movable arm 206 relative to one another. The movable arm position signal may instruct the movable arm 206 to move the free end 230 to the particular position with respect to the ride vehicle 202. In some embodiments, the movable arm position signal instructs the movable arm 206 to move the ride seat 208 to the particular position. In other embodiments, the movable arm position signal may instruct one rotational joint 236*c* of the plurality of rotation joints 236 or one arm segment 238*c* of the plurality of arm segments 238 of the movable arm to move to the particular position with respect to the ride vehicle 202. However, in another embodiment, the movable arm position signal may instruct the movable arm 206 to move multiple rotational joints 236 of the plurality of rotational joints 236 or multiple arm segments 238 of the plurality of arm segments 238 of the movable arm to particular positions, which may be advantageous under certain ride conditions by aiding in securing the movable arm 206.

For example, under certain ride conditions, the ride vehicle 202 may experience transverse forces with respect to a direction of travel 240 of the ride vehicle 202 along the ride track 204 (e.g., a hard curve in the ride track with minimal tilt such that the ride vehicle has minimal roll during the hard curve in the ride track). Under these ride conditions, the ride vehicle 202 and portions of the movable arm 206 may experience greater torsional forces (e.g., torque) when a center of mass of the movement arm is farther away from the ride vehicle in a direction substantially orthogonal 242 to both the direction of travel 240 of the ride vehicle 202 and the transverse forces. Thus, the movable arm position signal causing the movable arm 206 to move portions of the movable arm in the direction substantially orthogonal 242 to both the direction of travel 240 of the ride vehicle 202 and the transverse forces may reduce torque on the ride vehicle 202 and portions of the movable arm. However, another movable arm position signal to move multiple portions of the movable arm in the direction substantially orthogonal 242 to both the direction of travel 240 of the ride vehicle 202 and the transverse forces may further reduce torque on the ride vehicle and portions of the movable arm.

In some embodiments, the movable arm position signal is configured to move the movable arm 206 such that the center of mass of the movable arm 206 moves in a direction towards the center of mass of the ride vehicle base 218. In other embodiments, the movable arm position signal is configured to move the movable arm 206 such that the center of mass of the movable arm moves in a direction towards a ride track interface 244 between the ride vehicle base 218 and the ride track.

In some embodiments, an attraction event may require the ride seat 208 to be positioned in a lifted position (e.g., a position above the ride vehicle base) while the ride vehicle 202 is experiencing a ride condition associated with relatively higher forces (i.e., relative to a preceding portion of the ride). In such a situation, the movable arm position signal may be configured to move portions of the movable arm 206 toward the ride vehicle base 218 while maintaining the ride seat 208 in the lifted position. In another embodiment, an attraction event may require the ride seat 208 to move from a first position to a second position while the ride vehicle 202 is experiencing a ride condition. In such a situation, the movable arm position signal may be configured to move portions of the movable arm 206 toward the ride vehicle base 218 while maintaining the ride seat 208 in the lifted position and while moving the ride seat 208 from the first position to the second position. In another embodiment, an attraction event may require the ride seat 208 to maintain an extended position (e.g., position away from the ride vehicle base) while the ride vehicle 202 is experiencing a ride condition. In such a situation, the movable arm position signal may be configured to cause movement of portions of the movable arm 206 toward the ride vehicle base 218 while maintaining the ride seat 208 in the extended position. Additionally, in some embodiments, the movable arm position signal is configured to minimize movement of the free end 230 while moving the center of mass of the movable arm 206 in a direction towards the center of mass of the ride vehicle base 218.

In some embodiments, the ride vehicle 202 may have one or more locking mechanisms 268 for securing the movable arm 206. The locking mechanism 268 may be configured to move from a locked position to an unlocked position and vice versa in response to receiving a locking signal or an unlocking signal. In the unlocked position, the locking mechanism 268 allows rotation of the rotational joint. In the locked position, the locking mechanism 268 may be configured to block rotation of a rotational joint (e.g., 236*c*) of the plurality of rotational joints 236 to temporarily cause the rotational joint to become rigid. Additionally, in the locked position, stresses on the rotational joint are primarily transferred to the locking mechanism 268, such that the locking mechanism 268 reduces stress on the rotational joint. In some embodiments, each rotational joint of the plurality of rotational joints 236 has a corresponding locking mechanism 268. The locking mechanisms 268 may be positioned at or within the movable arm joints 236.

In another embodiment, the ride vehicle 202 may have a coupling device 246 for securing the movable arm 206. As shown in this embodiment, the coupling device 246 may reversibly couple the movable arm 206 to the ride vehicle base 218 in response to receiving a coupling signal. However, in other embodiments, the coupling device may couple the ride seat 208 to an additional portion of the movable arm (e.g., arm segment 238*a*), the ride seat 208 to the ride vehicle base 218, portions of the movable arm 206 to one another, or some combination thereof. In this manner, stresses and/or torque on the movable arm 206 are distributed between the base end 228 and the free-end 230 of the movable arm 206. The coupling may be reversed upon receipt of an uncoupling signal to permit movement of the movable arm 206 during parts of the ride cycle. The coupling device 246 may be a mechanical coupling device or a structural coupling device. For example, the coupling may be an interference coupling, a magnetic coupling, a mating of complementary features, etc.

In some embodiments, the coupling device 246 may mechanically couple the movable arm 206 to the ride vehicle base 218 in response to receiving the coupling signal. Any suitable coupling device 246 for mechanically coupling the movable arm 206, ride vehicle base 218, and the ride seat 208 to each other in various combinations may be incorporated. In some embodiments, the coupling device may have a hydraulic actuator, pneumatic actuator, electric actuator, mechanical actuator, or some combination thereof configured to drive a mechanical or structural coupling and uncoupling of the coupling device 246.

The coupling device (e.g., coupling device 246 as shown) may include a mating feature configured to engage with a complementary feature on the movable arm (e.g., movable arm 206). In one embodiment, the movable arm 206 may include a male mating feature configured to mate with a female mating feature (or vice versa) of the coupling device 246 to structurally couple the movable arm (as provided herein). The complementary mating features may include grooves and protrusions, slots and tabs, etc. Accordingly, in one embodiment, a portion of the coupling device 246*a* may be resident on the base 218 while another portion of the coupling device 246*b* may be resident on the movable arm 206. In the coupled configuration, the different portions of the coupling device 246 may be in direct contact with one other. To uncouple the movable arm 206 from the base 218, the different portions of the coupling device 246 may be moved/positioned apart from one another.

Figure 3:
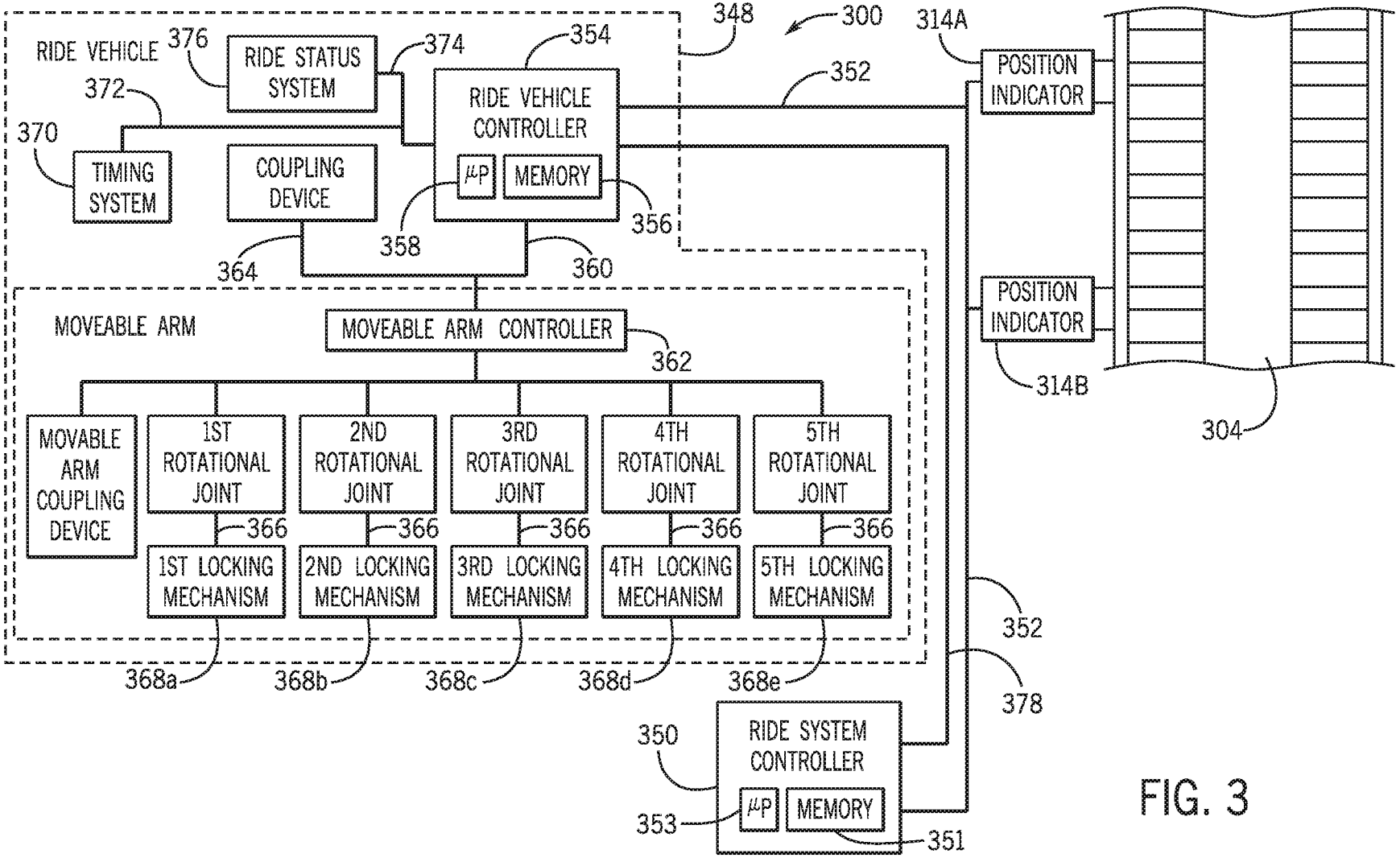
FIG. 3 is a block diagram of a ride vehicle control system, a ride system controller, and position indicators in accordance with present techniques.

FIG. 3 is a block diagram of a ride system 300 that includes a ride vehicle control system 348, a ride system controller 350, and the plurality of position indicators 314. As shown in the present embodiment, the position indicators 314*a* and 314*b* output the ride condition signal 352 to the ride system controller 350 and/or the ride vehicle control system 348. The ride condition signal 352 provides an indication that the ride vehicle is positioned at, near, or approaching a portion of the ride track 304 having a ride condition that is associated with a change in a configuration of a movable arm. In the present embodiment, a ride vehicle controller 354 of the ride vehicle control system 348 receives the ride condition signal 352, either directly or via the ride system controller 350. To facilitate these communications, the ride vehicle controller 354, the ride vehicle control system 348, the ride system controller 350, and the plurality of position indicators 314 may include communications circuitry, such as antennas, radio transceiver circuits, signal processing hardware and/or software (e.g., hardware or software filters, A/D converters, multiplexer amplifiers), or a combination thereof. The communications circuitry may be configured to communicate over wired or wireless communication paths via IR wireless communication, satellite communication, broadcast radio, microwave radio, Bluetooth, Zigbee, Wifi, UHF, NFC, etc. Such communication may also include intermediate communications devices, such as radio towers, cell towers, etc.

In certain embodiments, the system 300 may include a memory device (e.g., memory device 351 or memory device 356) storing instructions executable by a processor (e.g., processor 353 or processor 358) to perform the methods and to control actions described herein. For example, the processor 358 may execute instructions for a response 360 based on the ride condition signal 352 or other inputs received by the ride vehicle controller 354.

In some embodiments, the system 300 has stored a predetermined response to each individual ride condition signal of a plurality of ride condition signals. For example, the memory device 356 or the memory device 351 may have stored the following predetermined instructions: (1) instruct the movable arm to move to a first configuration in response to receiving a first ride condition signal from the first position indicator; (2) instruct the movable arm to move to a second configuration and output a coupling signal in response to receiving a second ride condition signal from the second position indicator; (3) output a third movable arm position signal to instruct the movable arm to move to a third configuration in response to receiving a third ride condition signal from the third position indicator; and (4) output a locking signal to each locking mechanism of the movable arm (e.g., a first locking mechanism 368*a*, a second locking mechanism 368*b*, a third locking mechanism 368*c*, a fourth locking mechanism 368*d*, a fifth locking mechanism 368*e*) in response to receiving a fourth ride condition signal from the fourth position indicator. In some embodiments, the movable arm is configured to move from the first configuration to a second configuration along a movement trajectory. The movement trajectory may be configured to reduce forces, torque, and/or stress on the movable arm. Further, the movement trajectory may be configured to reduce overall movement of the movable arm between the first and second configuration to reduce movement experienced by the ride vehicle seat. The movement trajectory may be stored as instructions on the memory device 356 or the memory device 351. The instructions may be selected and executed as appropriate. In one embodiment, the instructions are stored on the ride system controller 350 and communicated to each ride vehicle 302, e.g., to the ride vehicle controller 354. In other embodiments, the instructions are stored on the ride vehicle 302. One or more drive signals (movable arm position signal 360, coupling signal 364) may be communicated to the movable arm controller 362 in response to receiving the corresponding instructions.

In another embodiment, the system 300 causes execution of the predetermined response based at least in part on inputs related to a location of the ride vehicle along the ride track 304. The ride vehicle controller 354 and/or the ride system controller 350 may determine the location based at least in part on a timing system 370. In the depicted embodiment, the timing system 370 is shown on the ride vehicle 302. However, the timing system 370, additionally or alternatively, may be a component of the ride system controller 350. Specifically, the timing system 370 may output a current time 372 to the ride vehicle controller 354. The system 300 may be configured to have the ride vehicle controller 354 output a particular predetermined response (e.g., arm position signals, locking signals, or coupling signals) at a predetermined time during the amusement park attraction. The predetermined times may correspond to locations of the ride vehicle 302 along the ride track or a location of the ride vehicle 302 with respect to a track feature. Further, the ride vehicle controller 354 may receive a status input 374 from a ride status system 376 to calibrate the timing for outputting the particular predetermined response. In the depicted embodiment, the ride status system 376 is shown on the ride vehicle 302. However, the ride status system 376, additionally or alternatively, may be a component of the ride system controller 350.

The ride status system 376 may output a current speed of the ride vehicle 302. The ride vehicle controller 354 (or the ride system controller 350) may receive the current speed and compare the current speed to a current expected speed and determine if the current speed deviates from the current expected speed. The ride vehicle controller 354 may adjust the timing for outputting the predetermined response based at least in part on deviations from the current expected speed of the ride vehicle.

In other embodiments, the system 300 determines a dynamic response (e.g., take no action, output a movable arm position signal 362, output a locking signal 366, or output a coupling signal 364) to the ride condition signal 352 in real time. In such an embodiment, the plurality of position indicators 314 may be configured to output a variable ride condition signal. The variable ride condition signal is configured to indicate information regarding the severity of the track feature (e.g., speed of ride vehicle, degree of a change in direction of the ride track, or magnitude of expected forces and/or stress on the ride vehicle). For example, a position indicator 314*a* may output a first variable ride condition signal indicating the speed of the vehicle at the position indicator and the degree of change in direction of an upcoming track feature (e.g., a curve) in the ride track. The system 300 receives the variable condition signal and determines a first dynamic response. In some embodiments, the system 300 may have a plurality of ride condition thresholds. The system 300 may determine a dynamic response based at least in part on a comparison of the variable ride condition signal and the plurality of ride condition thresholds.

In some embodiments, the system 300 outputs the predetermined response or the dynamic response to reduce/distribute forces, torque, and/or stress on the movable arm or the ride vehicle base, or both. Additionally, the system 300 may determine a specific predetermined response or a specific dynamic response to optimally reduce/distribute forces, torque, and/or stress on the movable arm or the ride vehicle base, or both. In some embodiments, the system 300 may determine a specific predetermined response or a specific dynamic response to optimally reduce/distribute forces, torque, and/or stress on a particular rotational joint of the movable arm.

In some embodiments, the ride system controller 350 or the ride vehicle controller 354 may output the predetermined response or the dynamic response based at least in part on the ride condition signals or other inputs. Further, the ride system controller 350 or the ride vehicle controller 354 may output a ride vehicle control signal 378 to control movement of the ride vehicle. In some embodiments, the ride system controller 350 or the ride vehicle controller 354 outputs the ride vehicle control signal based at least in part on the ride condition signal 352 or other inputs.

Figure 4:
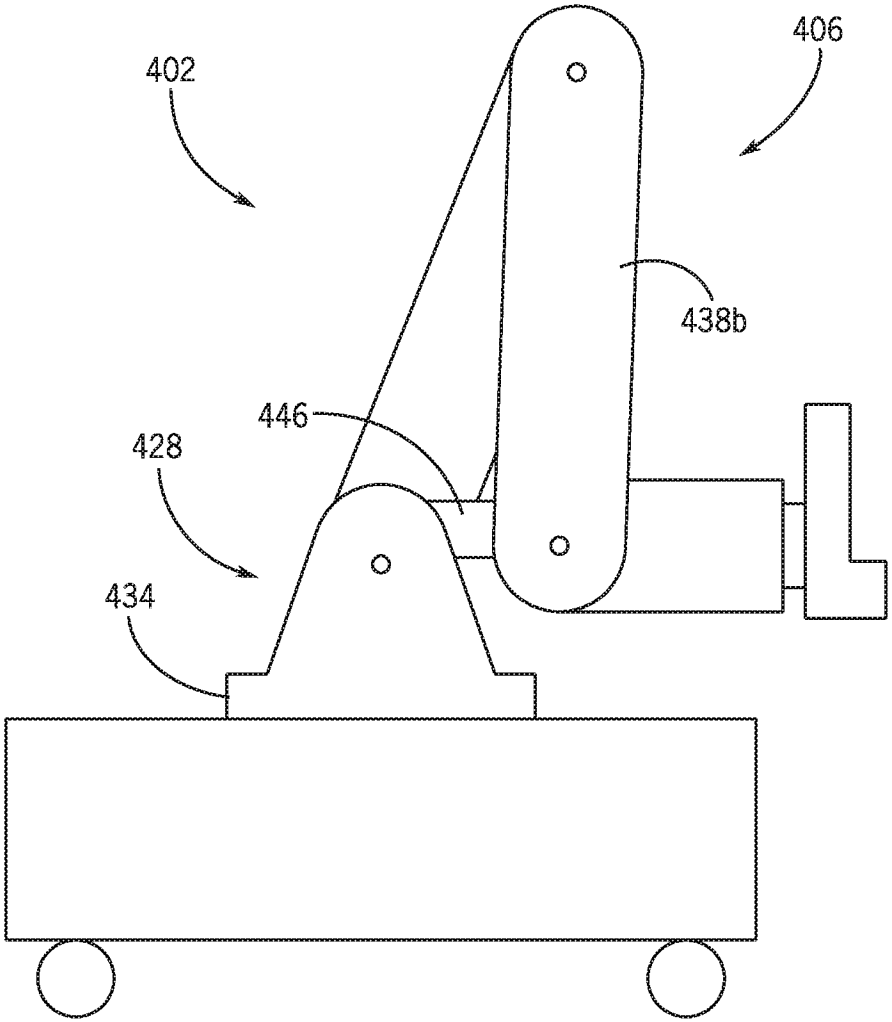
FIG. 4 is a side view of the ride vehicle having a portion of the movable arm coupled to a mounting structure in accordance with present techniques.

FIG. 4 is a side view of the ride vehicle 402 having a portion of the movable arm 406 coupled to the mounting unit 434. To secure the movable arm 406, a movable arm position signal may cause movement of the second segment 438*b* of the movable arm 406 to a position proximate the mounting unit 434. After the second segment 438*b* is in the position proximate the mounting unit 434, the ride vehicle controller may output a coupling signal to couple the movable arm 406 to the mounting unit 434 and coupled with the coupling device 446. The configuration of the movable arm 406 coupled to the mounting unit 434 via the coupling device 446, as depicted, may reduce forces, torque, and/or stress on the ride vehicle 402 by moving the center of gravity of the movable arm 406 closer to the center of gravity of the ride vehicle 402 (i.e., when compared to the position of the movable arm 206 in FIG. 2) and by fixing the movable arm 406 (e.g., a free-end of the movable arm 406) via the coupling device 446. Further, coupling a portion of the movable arm 406 proximate the free end to the mounting unit 434 (e.g., restraining the free end of the movable arm 406) may reduce torque at the base end 428 and other portions of the movable arm 406. Reducing torque at the base end 428 may reduce stress at the base end 428, which may increase the life span of the movable arm 406.

Figure 5:
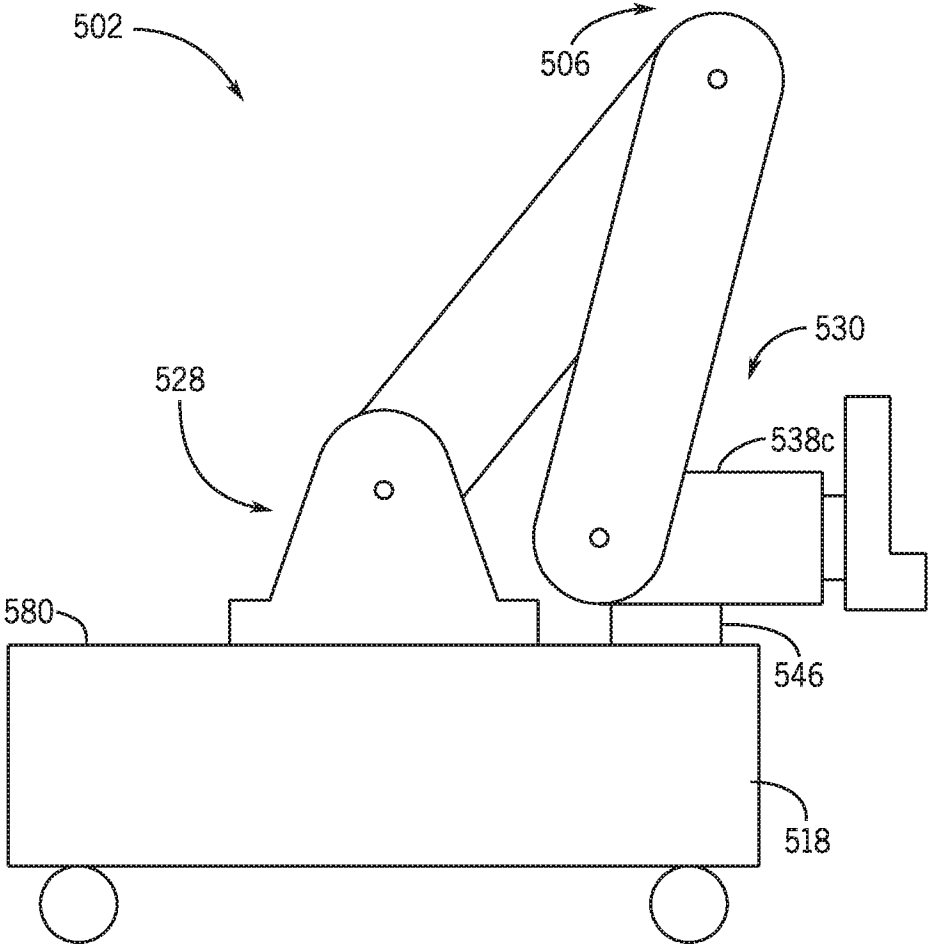
FIG. 5 is a side view of the ride vehicle having a portion of the movable arm coupled to a top surface of a ride vehicle base of the ride vehicle in accordance with present techniques.

FIG. 5 is a side view of the ride vehicle 502 having a portion of the movable arm 506 coupled to a surface, e.g., a top surface 580, of a ride vehicle base 518 of the ride vehicle 502. In response to a movable arm position signal, the movable arm may change configurations to move a third segment 538*c* of the movable arm 506 to a position proximate the top surface 580 of the ride vehicle base 518. After the third segment 538*c* is in the position proximate the top surface 580 of the ride vehicle base 518, execution of a coupling signal to couple the movable arm 506 to the top surface 580 of the ride vehicle base 518 with the coupling device 546 may be triggered. That is, in certain embodiments, execution of the coupling signal is triggered by the positioning of the movement arm 506 in an appropriate configuration to permit engagement of the coupling device 546 to the movable arm 506. The depicted configuration of the movable arm 506 with the third segment 538*c* proximate to the top portion 580 of the ride vehicle base 518 may reduce forces, torque, and/or stress on the ride vehicle 502 by moving the center of gravity of the movable arm closer to the center of gravity of the ride vehicle 502 (i.e., when compared to the position of the movable arm 206 in FIG. 2). Further, coupling a portion of the movable arm proximate the free end 530 to the top surface 580 of the ride vehicle base 518, e.g., via the coupling device 546, may reduce forces, torque, and/or stress at the base end 528 and other portions of the movable arm 506 by distributing forces, torque, and/or stress between the base end 528 and the free end 530 of the movable arm 506.

Figure 6:
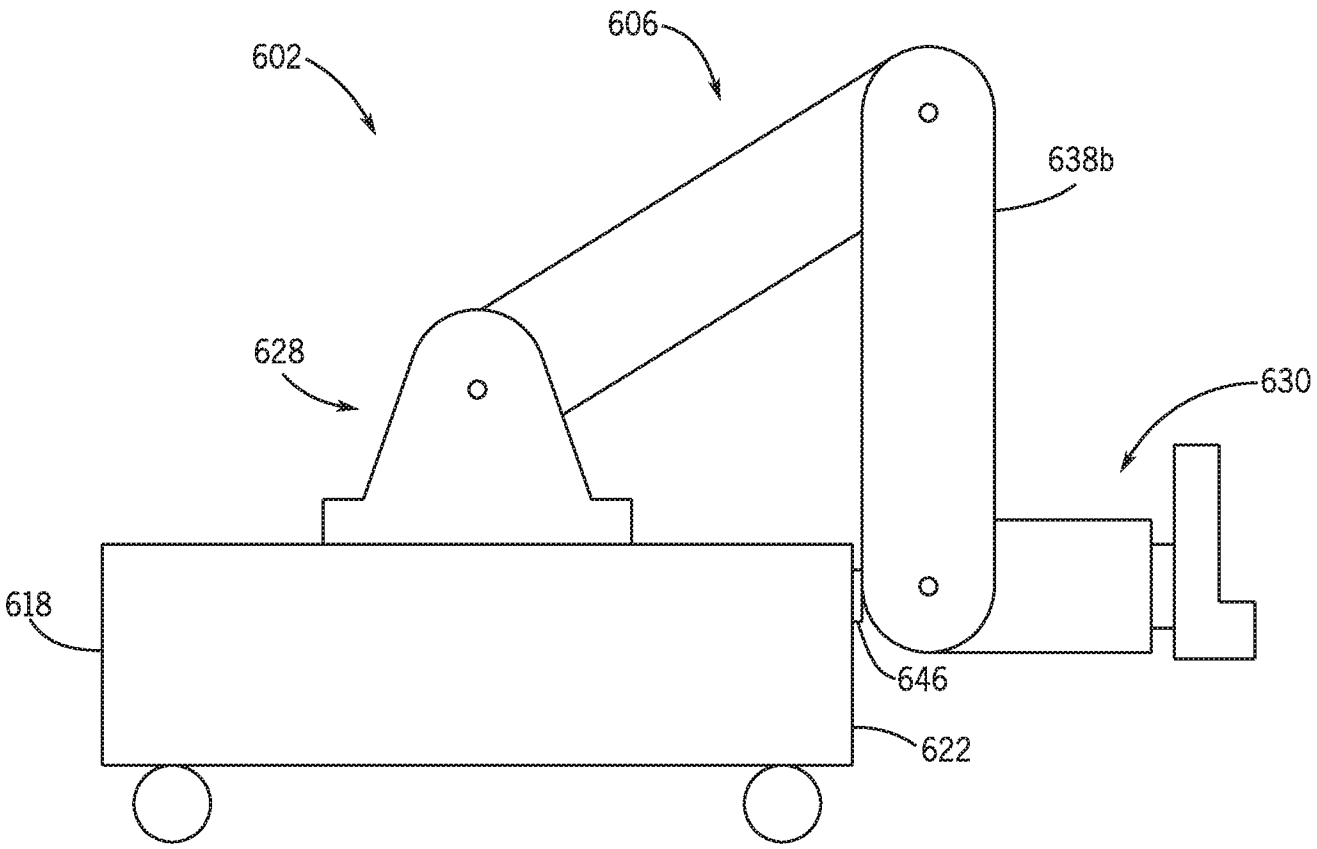
FIG. 6 is a side view of the ride vehicle having a portion of the movable arm coupled to a front surface of the ride vehicle base in accordance with present techniques.

FIG. 6 is a side view of the ride vehicle 602 having a portion of the movable arm 606 coupled to a front portion 622 of the ride vehicle base 618. A movable arm position signal may cause movement of the second arm segment 638*b* of the movable arm 602 to a position proximate the front portion 622 of the ride vehicle base 618. After the second arm segment 638*b* is in the position proximate the front portion 622 of the ride vehicle base 618, the ride vehicle controller may cause execution of a coupling signal to couple the movable arm 606 to the front portion 622 of the ride vehicle base 618 with the coupling device 646. Moving the movable arm 602 to the front portion 622 of the ride vehicle base 618 as depicted may reduce forces, torque, and/or stress on the ride vehicle 602 by moving the center of gravity of the movable arm closer to the center of gravity of the ride vehicle 602 (i.e., when compared to the position of the movable arm 206 in FIG. 2). Further, coupling a portion of the movable arm 606 proximate the free end 630 to the front portion of the ride vehicle base 618 may reduce forces, torque, and/or stress at the base end 628 and other portions of the movable arm 606 by distributing forces, torque, and/or stress between the base end 628 and the free end 630 of the movable arm 606.

Figure 7:
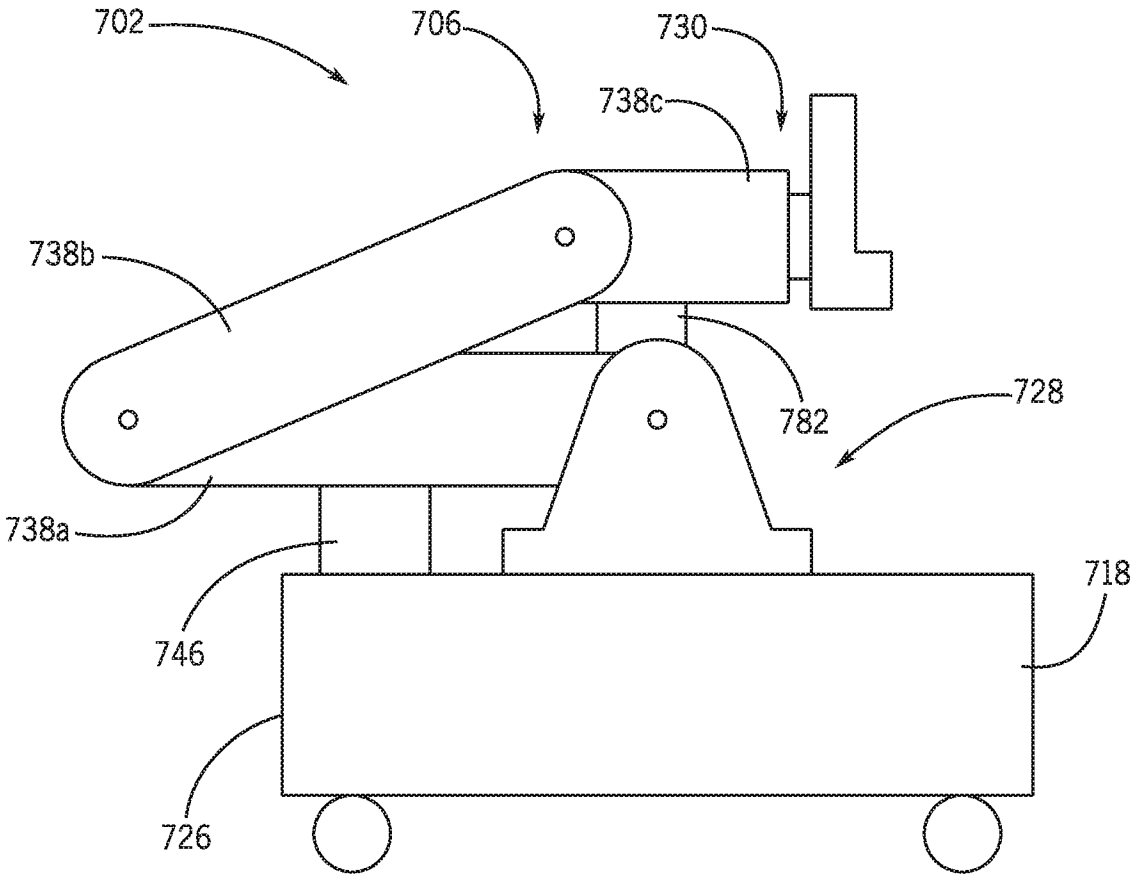
FIG. 7 is a side view of the ride vehicle having a plurality of coupling devices in accordance with present techniques.

FIG. 7 is a side view of the ride vehicle 702 having a plurality of coupling devices 746. In some embodiments, the movable arm 706 includes a movable arm coupling device 782 that may couple a first portion of the movable arm 706 to a second portion of the movable arm 706. For example, a first movable arm position signal may trigger movement of the first arm segment 738*a* of the movable arm 706 to a position proximate the back portion 726 of the ride vehicle base 718. Additionally, a second movable arm position signal may trigger movement of the second arm segment 738*b* of the movable arm 706 to a position proximate the first arm segment 738*a* of the movable arm. Further, a third movable arm position signal may trigger movement of the third arm segment 738*c* of the movable arm 706 to a position proximate the second arm segment 738*b* of the movable arm 706. After the first 738*a*, second 738*b*, and third segments 738*c* move to their corresponding positions to assume a desired configuration, the ride vehicle controller may output a first coupling signal to couple the first arm segment 738*a* of the movable arm 706 to the rear portion 726 of the ride vehicle base 718 with the coupling device 746 and a second coupling signal to couple the third arm segment 738*c* of the movable arm 706 to the second arm segment 738*b* of the movable arm 706 with the movable arm coupling device 782. Moving the first arm segment 738*a*, second arm segment 738*b*, and third arm segment 738*c* of the movable arm 706, as depicted, may reduce forces, torque, and/or stress on the ride vehicle 702 by moving the center of gravity of the movable arm 706 closer to the center of gravity of the ride vehicle base 718 (i.e., when compared to the position of the movable arm 206 in FIG. 2). Further, coupling the first arm segment 738*a* of the movable arm 706 to the rear portion 726 of the ride vehicle base 718 and coupling the third arm segment 738*c* of the movable arm 706 to the second arm segment 738*b* of the movable arm 706 may reduce forces, torque, and/or stress at the base end 728 and other portions of the movable arm 706 by distributing forces, torque, and/or stress between the base end 728 and the free end 730 of the movable arm 706.

Figure 8:
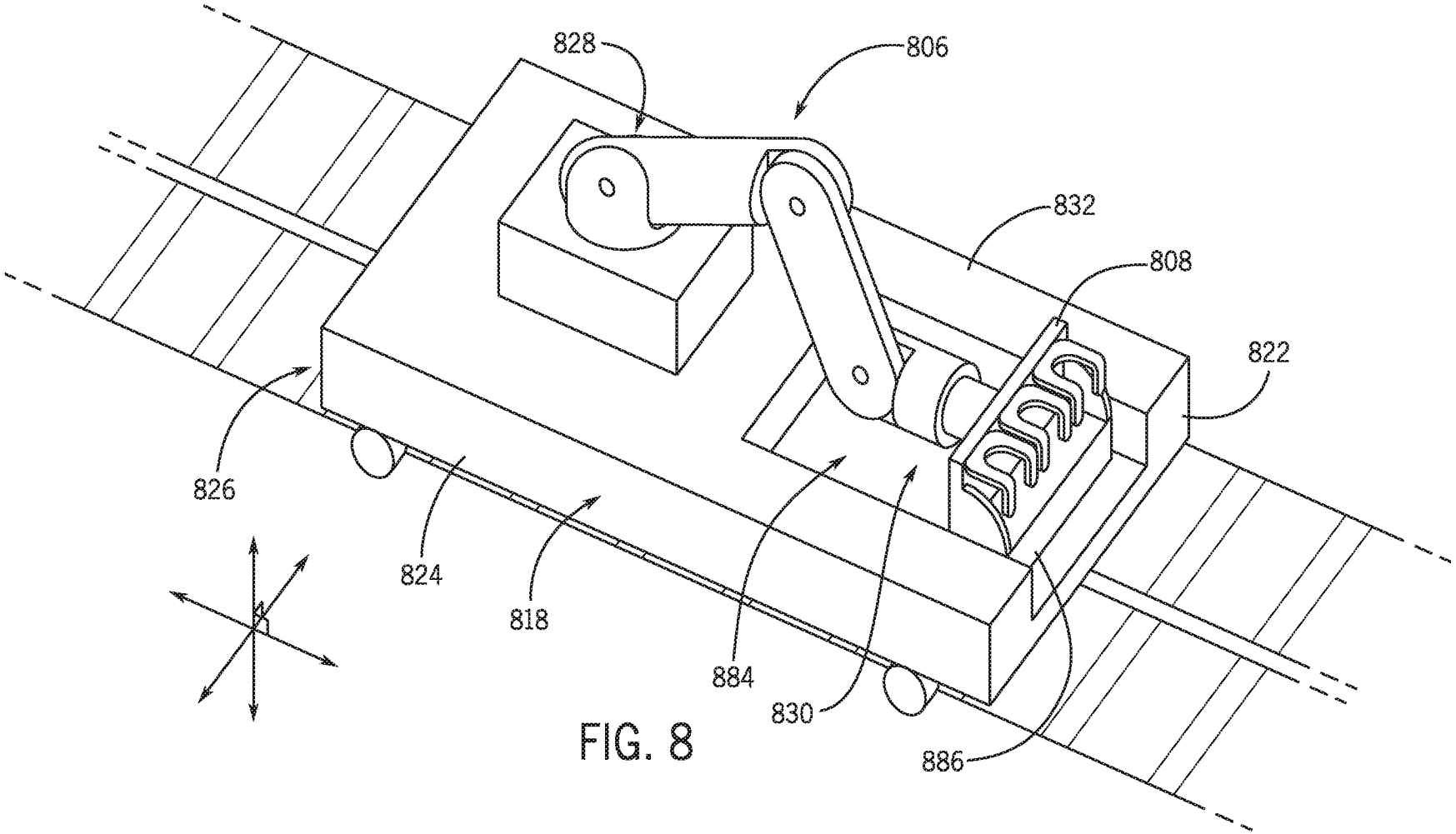
FIG. 8 is a perspective view of the ride vehicle base having a recess in accordance with present techniques.

FIG. 8 is a perspective view of the ride vehicle base 818 having a recess 884 that may act as the coupling device as provided herein. In some embodiments, the ride vehicle has a recess 884 in a portion of the ride vehicle base 818. The recess 884 may be in the top portion 832. In some embodiments the recess 884 is in a front portion 822, back portion 826, or side portion 824 of the ride vehicle base 818. In other embodiments, the ride vehicle base 818 may have a recess 884 open to multiple sides of the ride vehicle base. In the present embodiment, the recess 884 is open to both the top portion 832 and front portion 822 of the ride vehicle. The recess 884 may seat a portion of the movable arm 806, the ride seat 808, or some combination thereof. A width or length of the recess 884 may be greater than a width of length of the ride seat 808 such that at least a bottom portion 886 of the ride seat 808 may sit in the recess 884. A depth of the recess 884 may be greater than a height of the ride seat 808 such that the ride seat 808 may sit entirely within the recess 884. In some embodiments, the recess 884 may contact portions of the movable arm 806 or ride seat 808. Specifically, the recess 884 may at least contact side portions of the movable arm or ride seat 808 such that the recess 884 may at least support a portion of the movable arm 806, the ride seat 808, or some combination thereof from forces transverse to the direction of travel of the ride vehicle. In some embodiments, the recess 884 may at least support a portion of the movable arm 806, the ride seat 808, or some combination thereof from other forces and/or torque exerted on the movable arm 806. That is, the stress at the base end 828 may be decreased by distributing forces, torque, and/or stress between the base end 828 and the free end 830 of the movable arm 806.

Figure 9:
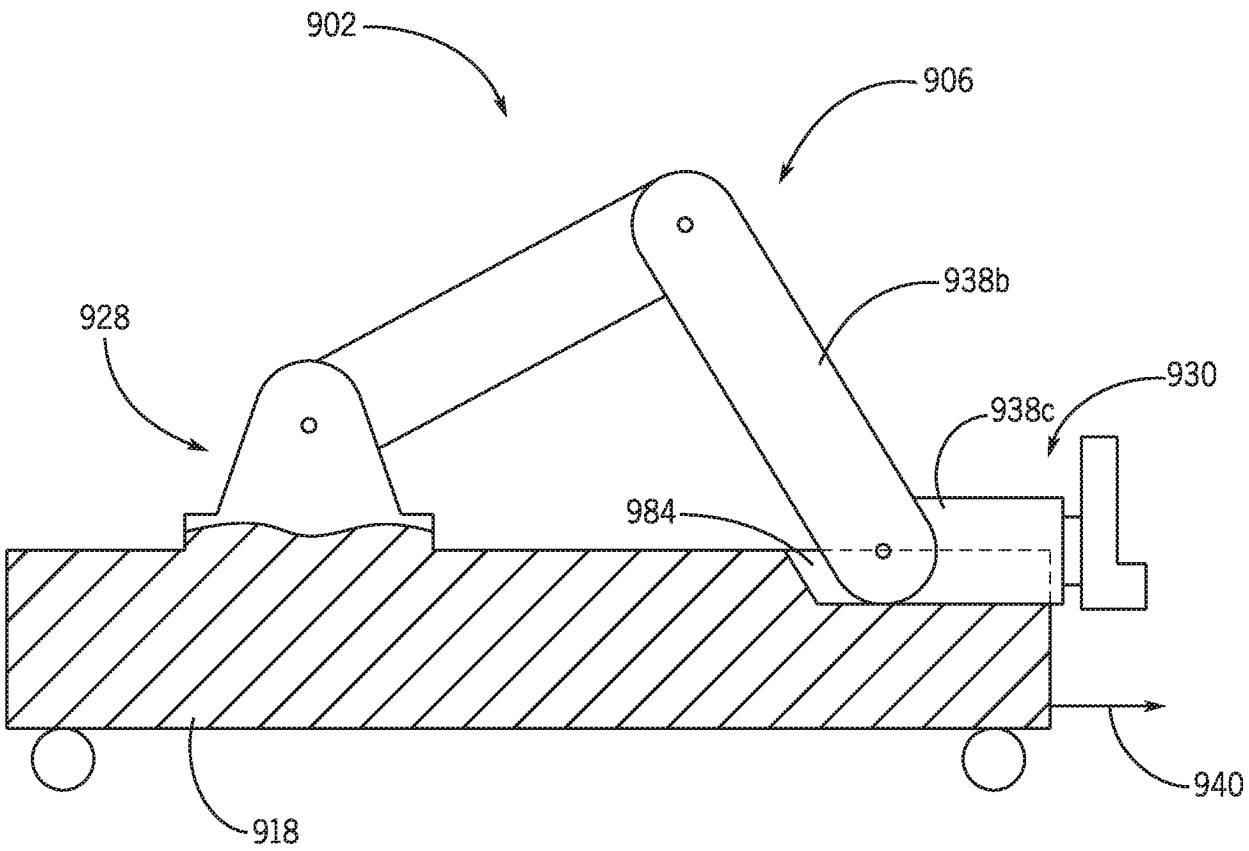
FIG. 9 is a cross-sectional view of the movable arm positioned in the recess in accordance with present techniques.

FIG. 9 is a cross-sectional view of the movable arm 906 positioned in the recess 984 of the ride vehicle 902. To secure the movable arm 906, the ride vehicle controller (e.g., directly or via the ride system controller) may output a movable arm position signal to move the second arm segment 938*b* and third arm segment 938*c* of the movable arm 906 to a position within the recess 984. Moving portions of the movable arm 906 into the recess 984 may reduce forces, torque, and/or stress on the vehicle by moving the center of gravity of the movable arm 906 closer to the center of gravity of the ride vehicle (i.e., when compared to the position of the movable arm 206 in FIG. 2). Further, the recess 984 blocks movement of the movable arm 906 in at least the direction transverse to the direction of travel 940 of the ride vehicle 902. Thus, the recess 984 acts as an anchor to hold a portion of the movable arm 906 proximate the free end 930 in place against certain force vectors. Anchoring the portion of the movable arm 906 proximate the free end 930 within the recess 984 of the ride vehicle base 918 may reduce forces, torque, and/or stress at the base end 928 and other portions of the movable arm 906 by distributing forces, torque, and/or stress between the base end 928 and the free end 930 of the movable arm 906.

Figure 10:
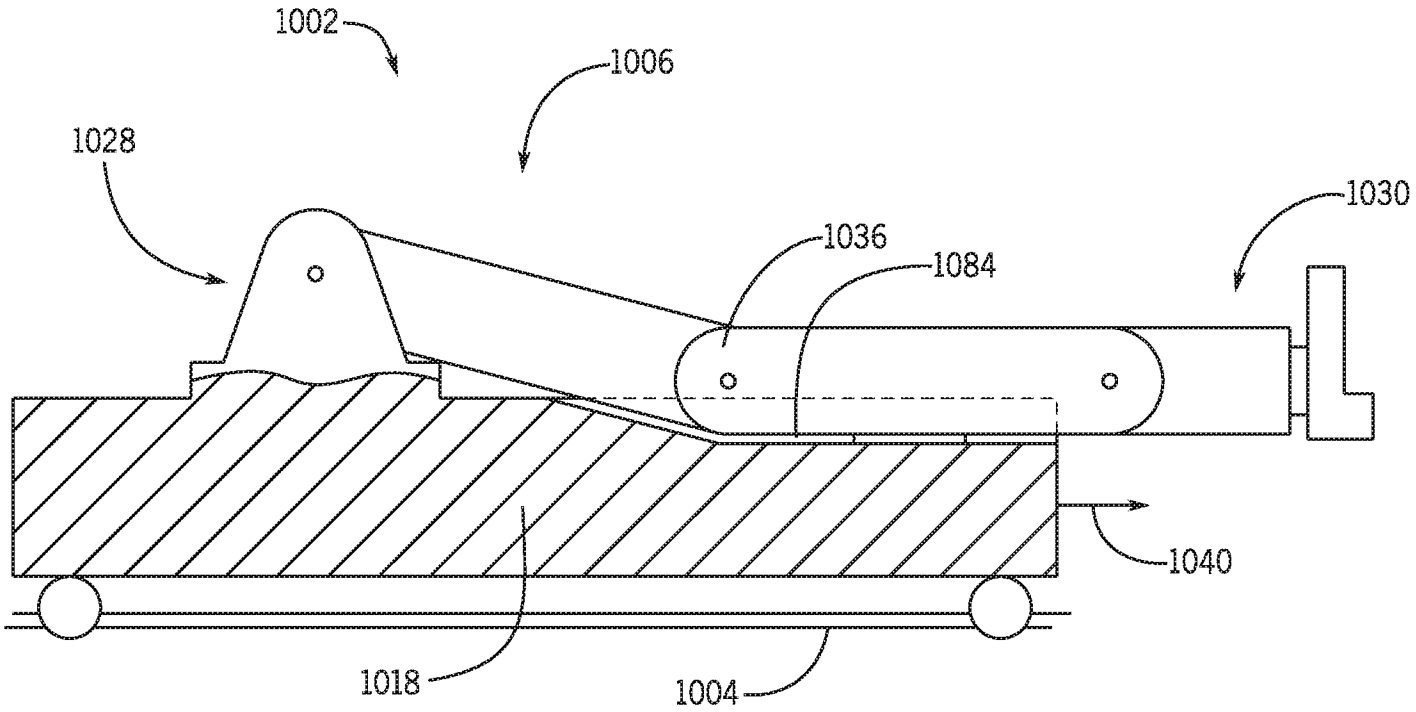
FIG. 10 is a cross-sectional view of the movable arm coupled to a portion of the recess in accordance with present techniques.

FIG. 10 is a cross-sectional view of the moveable arm 1006 coupled to a portion of the recess 1084. To secure the moveable arm 1006, the ride vehicle controller may output a moveable arm position signal to move one of the plurality of rotational joints 1036 of the moveable arm 1006 in a direction toward the ride track 1004. In some embodiments, the ride vehicle controller may output a moveable arm position signal to move the one of the plurality of rotational joints 1036 to a position within the recess 1084. Moving the one of the plurality of rotational joints 1036 and portions of the moveable arm 1006 into the recess may reduce forces, torque, and/or stress on the vehicle by moving the center of gravity of the moveable arm 1006 closer to the center of gravity of the ride vehicle base 1018 (i.e., when compared to the position of the moveable arm 206 in FIG. 2). Further, the recess 1084 blocks movement of the moveable arm 1006 in at least the direction transverse to the direction of travel 1040 of the ride vehicle 1002. Thus, the recess 1084 acts as an anchor to hold the one of the plurality of rotational joints 1036 and the portion of the moveable arm 1006 proximate the free end 1030 in place against certain force vectors. Anchoring the one of the plurality of rotational joints 1036 and the portion of the moveable arm 1006 proximate the free end 1030 within the recess of the ride vehicle base 1118 may reduce forces, torque, and/or stress at the base end 1028 and other portions of the movable arm by distributing forces, torque, and/or stress between the base end 1028 and the free end 1030 of the movable arm 1006.

Figure 11A:
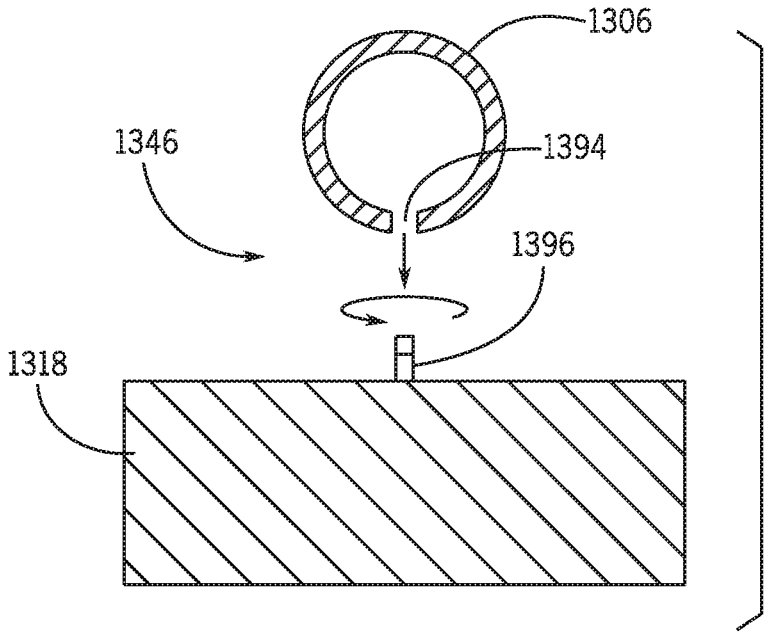
FIG. 11A is a cross-sectional view of a coupling device having a movable arm with a slot and a rotating pin in a non-coupled position in accordance with present techniques.
Figure 11B:
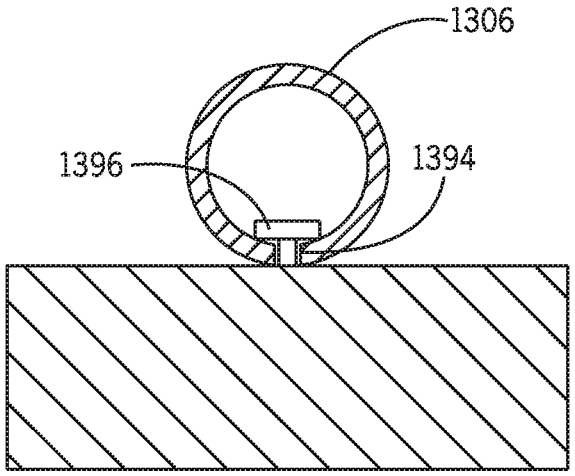
FIG. 11B is a cross-sectional view of the coupling device having the movable arm with the slot and the rotating pin in a coupled position in accordance with present techniques.

As provided herein, the movable arm may be locked at one or more joints via a locking mechanism and/or coupled to itself or external structures to provide stiffness and reduce the torsional or other forces experienced by portions of the movable arm via a coupling device. FIGS. 11-14 depict various embodiments of complementary mating features that may be incorporated into locking mechanisms and/or coupling devices as provided herein. It should be understood that the depicted embodiments are by way of example only, and that other implementations are contemplated. FIGS. 11A-B show a pin-based locking or coupling feature. Further, it should be understood that one or more features of the depicted embodiments may operate under processor-based control to switch between locked/unlocked or coupled/uncoupled configurations. In addition, while certain depicted embodiments are shown in the context of coupling mechanisms, it should be understood that the depicted features may also be implemented as a joint locking mechanism as provided herein and vice versa.

FIG. 11A is a cross-sectional view of the movable arm 1306 with a slot 1394 and a rotating pin 1396 in a non-coupled position. In the present embodiment, the movable arm 1306 has a slot 1394 sized to allow passage of a rotating pin 1396 mounted on a portion of the ride vehicle base. In some embodiments, the depicted coupling device 1346 (e.g., slot and rotating pin) may be installed on or in any portion of the ride vehicle. For example, the coupling device 1346 may be installed to couple the movable arm 1306 to the ride vehicle base 1318, the movable arm 1306 to a portion of the recess, the movable arm 1306 to the second recess, the movable arm 1306 to another portion of the movable arm 1306, the movable arm 1306 to the mounting unit, the ride seat to the ride vehicle base 1318, the ride seat to the recess, the ride seat to the second recess, the ride seat to another portion of the movable arm 1306, or any other coupling location.

FIG. 11B is a cross-sectional view of the movable arm 1306 with a slot 1394 and a rotating pin 1396 in a coupled position. In the depicted embodiment, the ride vehicle controller outputs a movable arm position signal to move the movable arm 1306 to a configuration such that the slot 1394 fits over the rotating pin 1396. After the movable arm 1306 is positioned such that the slot 1394 fits over the rotating pin 1396, the ride vehicle controller outputs a coupling signal to rotate the rotating pin 1396 to the coupled position. In the coupled position, the pin 1396 may block movement of the movable arm 1306.

Figure 12A:
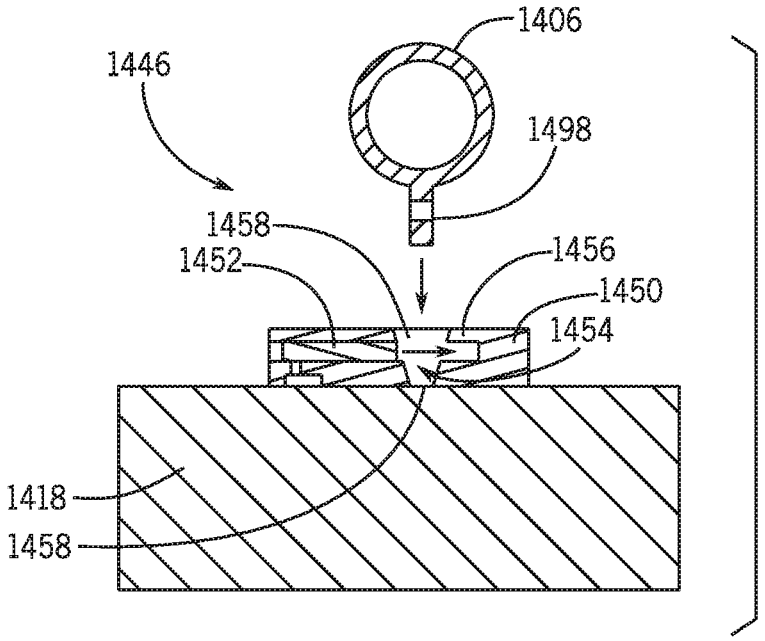
FIG. 12A is a cross-sectional view of another embodiment of the coupling in a non-coupled position in accordance with present techniques.

FIG. 12A is a cross-sectional view of an example of complementary mating features of an embodiment of a coupling device 1446. In the depicted embodiment, the coupling device 1446 includes a slotted fin 1498 mounted to a portion of the movable arm 1406 and an actuatable piston base 1450 attached to the ride vehicle base 1418. In the non-coupled position, an actuatable piston 1452 is disposed in a retracted position such that a guided recess 1454 in the actuatable piston base 1450 is open. The guided recess 1454 may have angled side walls 1456 to guide the slotted fin 1498 toward a bottom 1458 of the guided recess 1454.

Figure 12B:
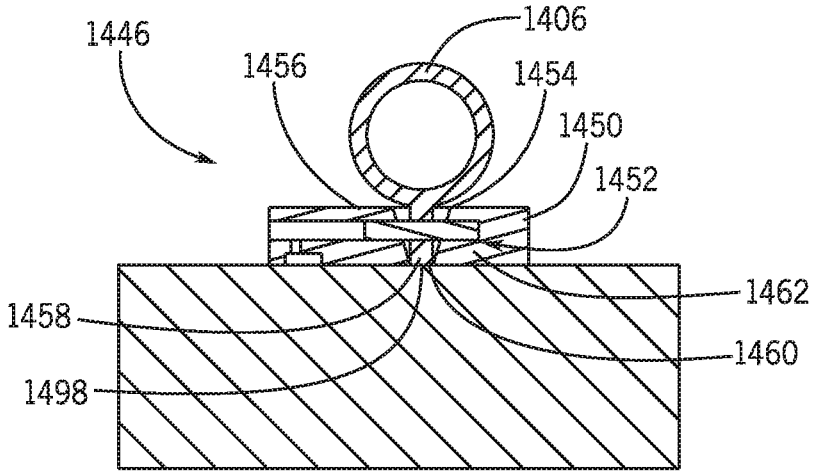
FIG. 12B is a cross-sectional view of another embodiment of the coupling in a coupled position in accordance with present techniques.

FIG. 12B is a cross-sectional view of the coupling device 1446. In the present embodiment, the ride vehicle controller outputs a movable arm position signal to move the slotted fin 1498 mounted to the movable arm 1406 to a position such that the slotted fin 1498 sits in the guided recess 1454 with a bottom portion 1460 of the slotted fin 1498 resting on the bottom 1458 of the guided recess 1454. The angled side walls 1456 may assist in positioning the slotted fin 1498 by blocking undesired movement of the slotted fin caused by external forces (e.g., ride conditions). After the slotted fin 1498 is positioned such that the slotted fin 1498 sits in the guided recess 1454 with the bottom portion 1460 of the slotted fin 1498 resting on the bottom 1458 of the guided recess 1454, the ride vehicle controller outputs a coupling signal to actuate the actuatable piston 1452 to the coupled position. The actuatable piston 1452 extends through a slot in the slotted fin and extends into a receiving portion 1462 of the actuatable piston base 1450 while moving to the coupled position. In the coupled position, the actuatable piston 1452 may block movement of the slotted fin 1498, which blocks movement of the movable arm 1406.

Figure 13A:
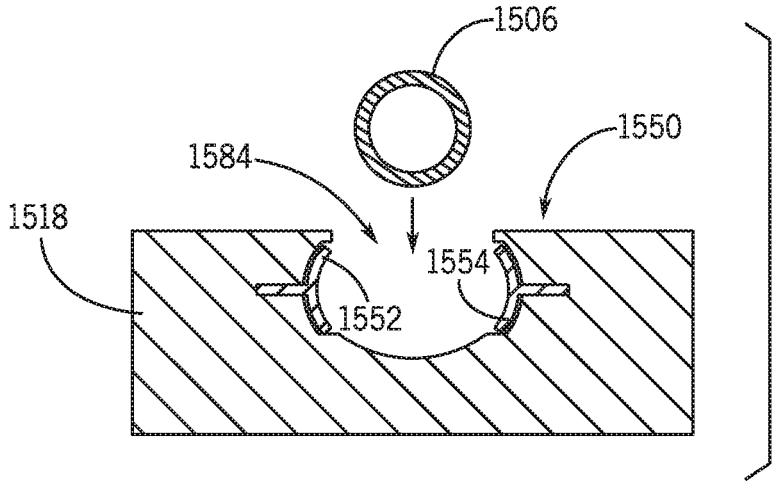
FIG. 13A is a cross-sectional view of a further embodiment of the coupling device having a clamping system in a non-coupled position in accordance with present techniques.

FIG. 13A is a cross-sectional view of the movable arm 1506 and a coupling device that includes a clamping system 1550, e.g., depicted in a non-coupled position. The coupling device may include a clamping system 1550 having at least one actuatable clamp. In some embodiments, the at least one actuatable clamp may force the movable arm 1506 against a portion of the ride vehicle base 1518, the recess 1584, or another clamp to block movement of the movable arm 1506. In the present embodiment, the coupling device includes a first clamp 1552 and a second clamp 1554 disposed within the recess 1584. However, the first clamp 1552 and second clamp 1554 may be mounted to any portion of the ride vehicle base 1518. In the non-coupled position, the first clamp 1552 and second clamp 1554 may be in retracted positions.

Figure 13B:
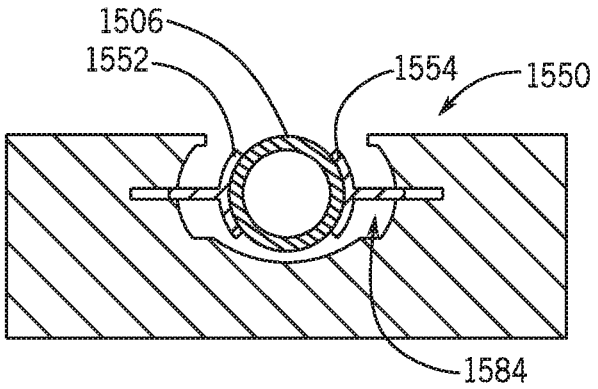
FIG. 13B is a cross-sectional view of a further embodiment of the coupling device having the clamping system in a coupled position in accordance with present techniques.

FIG. 13B is a cross-sectional view of the movable arm 1506 and the clamping system 1550 in a coupled position. To secure the movable arm, the ride vehicle controller outputs a movable arm position signal to move the movable arm 1506 along one or more motion-controlled axes to a position such that the movable arm 1506 is disposed within the recess 1584 and between the first clamp 1552 and second clamp 1554. After the movable arm 1506 is positioned such that the movable arm 1506 is disposed within the recess 1584 and between the first clamp 1552 and second clamp 1554, the ride vehicle controller outputs a coupling signal to actuate the first clamp and second clamp to the coupled position. In the coupled position, the first clamp 1552 and the second clamp 1554 may press against substantially opposite sides of the movable arm 1506, which may block movement of the movable arm.

Figures 14A, 14B:
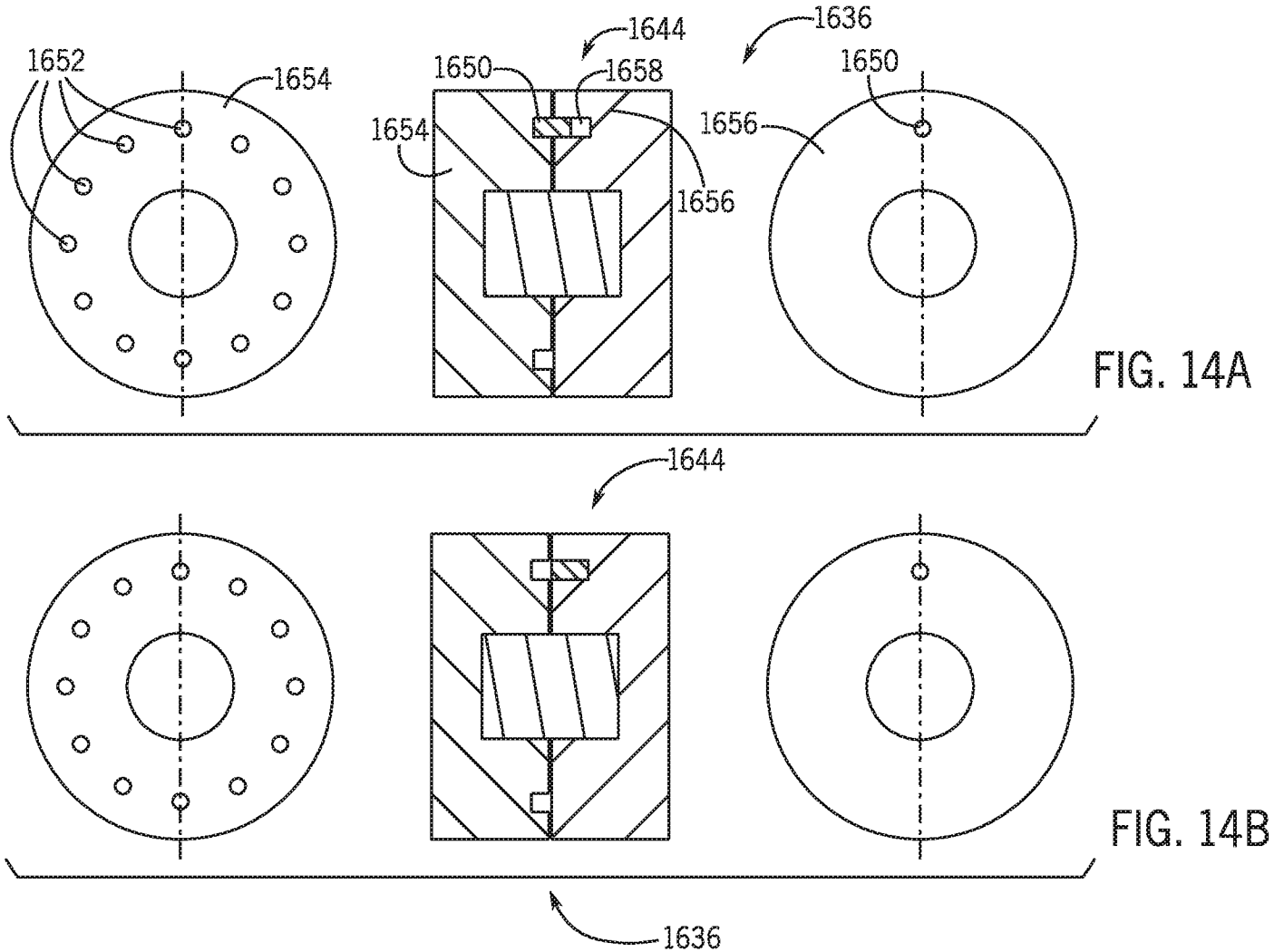
FIG. 14A is a cross-sectional view of a rotatable joint having a locking mechanism in a locked position in accordance with present techniques.
FIG. 14B is a cross-sectional view of a rotatable joint having a locking mechanism in an unlocked position in accordance with present techniques.

FIG. 14A is a cross-sectional view of one of the plurality of rotatable joints 1636 having a locking mechanism 1644 in a locked position. In some embodiments, the locking mechanism 1644 has an actuatable pin 1650 and a plurality of discontinuous slots 1652. A first portion 1654 of an individual rotational joint 1636 may have a plurality of discontinuous slots 1652 disposed circumferentially around a rotational axis of the individual rotational joint 1636. A second portion 1656 of the individual rotational joint 1636, opposite the first portion 1654 of the individual rotational joint, may have the actuatable pin 1650 disposed within a recess 1658 of the second portion of the rotational joint while in the unlocked position. In the locked position, the actuatable pin 1650 is configured to actuate outwards from the recess 1658 such that a portion of the actuatable pin 1650 remains in the recess 1658 and another portion of the actuatable pin 1650 extends into one of the plurality of discontinuous slots 1652. Having a portion of the actuatable pin 1650 in the recess 1658 and another portion of the actuatable pin 1650 in one of the plurality of discontinuous slots 1652 may block rotational movement of the individual rotational joint 1636. The plurality of discontinuous slots 1652 may have sensors to indicate to the ride vehicle controller that the locking mechanism 1644 is in the locked position to prevent the ride vehicle controller from outputting a movable arm position signal while the locking mechanism 1644 is engaged. In the depicted embodiment, the locking mechanism 1644 is in the locked position.

FIG. 14B is a cross-sectional view of the one rotatable joint 1636 having a locking mechanism 1644. In the present embodiment, the locking mechanism 1644 is in the unlocked position. The one rotatable joint 1636 may function normally when the locking mechanism 1644 is in the un-locked position.

Figure 15:
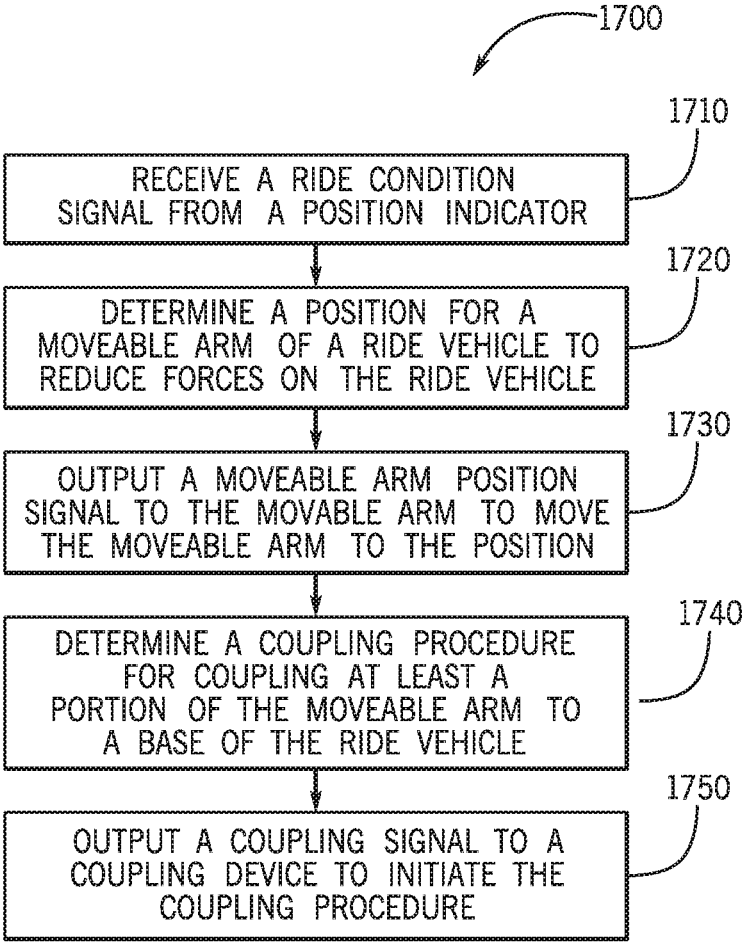
FIG. 15 is flow diagram of a method to reduce/distribute forces or stress on the ride vehicle at ride track features in accordance with present techniques.

FIG. 15 is a flow diagram of a method 1700 to reduce/distribute forces, torque, and/or stress on the ride vehicle at ride track features. At the start of the method, the movable arm may be in a first configuration, e.g., based on a first movable arm position signal that causes the movable arm to assume the first configuration. It should be understood that the first configuration may include positions of various portions of the movable arm, the free end coupled to passenger seats, locking mechanisms, coupling devices, etc. The method includes the step of receiving a ride condition signal, e.g., from a position indicator (block 1710), wherein the ride condition signal may be indicative or representative of a position of the ride vehicle at, near, or approaching a portion of the ride track that is associated with, or configured to, cause the ride vehicle to experience forces and/or stresses above a predetermined threshold. The ride condition signal may be received by the ride controller or the ride vehicle controller.

The method may include the step of determining a position for the movable arm of the ride vehicle to reduce/distribute forces, torque, and/or stress on the ride vehicle (block 1720), and outputting the movable arm position signal to the movable arm to move the movable arm to a second configuration (block 1730). For example, the ride controller may output the movable arm position signal to the movable arm (e.g., via the ride vehicle controller or the movable arm controller) to cause the movable arm to transition from the first configuration to the second configuration.

In the present embodiment, the method 1700 further includes determining a coupling procedure for coupling at least a portion of the movable arm to a base of the ride vehicle (block 1740), wherein the coupling procedure includes instructions for coupling the movable arm to the base of the ride vehicle once the movable arm is in the position. Additionally, the method 1700 includes outputting the coupling signal to a coupling device of the ride vehicle base, the movable arm, or some combination thereof to initiate the coupling procedure (block 1750). The method 1700 may also include one or more steps for uncoupling or unlocking various mechanisms based on a ride condition signal. For example, the method 1700 may include a step of sending an unlocking signal to a locking device.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride vehicle system, comprising:

a ride vehicle comprising:

a ride vehicle base configured to interface with a ride track, wherein the ride vehicle base is configured to move along the ride track;

a movable arm comprising a base end and a free end, the movable arm configured to move along one or more motion-controlled axes, wherein the movable arm is mounted to the ride vehicle base at the base end;

a ride seat coupled to the free end of the movable arm; and a coupling device configured to reversibly couple a first portion of the movable arm to the ride vehicle base, the ride seat to a second portion of the movable arm, the ride seat to the ride vehicle base, or a combination thereof; and a ride vehicle controller, wherein the ride vehicle controller is configured to:

receive a ride condition signal, wherein the received ride condition signal is configured to indicate that the ride vehicle is approaching a portion of the ride track associated with a ride condition, and wherein the ride condition is configured to cause the ride vehicle to experience forces above a predetermined threshold; and activate the coupling device to couple, during the ride condition, the first portion of the movable arm to the ride vehicle base, the ride seat to the second portion of the movable arm, the ride seat to the ride vehicle base, or a combination thereof based on the received ride condition signal.

2. The ride vehicle system of claim 1, wherein the coupling device is configured to at least mechanically or structurally couple a first portion of the movable arm to the ride vehicle base, the ride seat to the second portion of the movable arm, the ride seat to the ride vehicle base, or a combination thereof.

3. The ride vehicle system of claim 1, wherein the first portion of the movable arm comprises the free end of the movable arm, and wherein the coupling device is configured to couple the free end of the movable arm to the ride vehicle base.

4. The ride vehicle system of claim 1, wherein the ride vehicle controller is configured to output a movable arm position signal based at least in part on the received ride condition signal; and wherein the movable arm is configured to move with respect to the ride vehicle base in response to receiving the movable arm position signal.

5. The ride vehicle system of claim 1, wherein the coupling device comprises a hydraulic actuator, pneumatic actuator, electric actuator, mechanical actuator, or some combination thereof configured to cause coupling and uncoupling of the coupling device and wherein the coupling device is responsive to a coupling signal and an uncoupling signal to cause the coupling and uncoupling, respectively.

6. The ride vehicle system of claim 1, wherein the ride vehicle base comprises a recess configured to seat the first portion of the movable arm, the second portion of the movable arm, the ride seat, or some combination thereof.

7. The ride vehicle system of claim 6, wherein the coupling device is disposed within the recess and configured couple the recess to the first portion of the movable arm, the second portion of the movable arm, the ride seat, or some combination thereof.

8. The ride vehicle system of claim 1, wherein the movable arm is configured to move the free end of the movable arm with at least six degrees of freedom.

9. The ride vehicle system of claim 1, wherein the movable arm comprises a plurality of arm segments moveably coupled to each other via at least one rotational joint.

10. The ride vehicle system of claim 9, wherein the movable arm comprises a locking mechanism, wherein the locking mechanism is configured to block rotation of the at least one rotational joint to temporarily form a rigid joint.

11. The ride vehicle system of claim 1, wherein the ride condition comprises a shape or angle of the ride track, a speed of the ride vehicle above a threshold, or some combination thereof.

12. The ride vehicle system of claim 1, wherein the ride vehicle controller is configured to determine a position for the movable arm to generate a movable arm position signal, based at least in part on the received ride condition signal, to reduce forces on at least one rotational joint of the movable arm.

13. The ride vehicle system of claim 1, wherein the ride vehicle controller is configured to determine a position for the movable arm to generate a movable arm position signal, based at least in part on the received ride condition signal, to reduce forces on the movable arm, the ride vehicle base, or some combination thereof.

14. The ride vehicle system of claim 1, wherein the ride vehicle controller causes movement of the movable arm such that a center of mass of the movable arm moves towards a center of mass of the ride vehicle base.

15. The ride vehicle system of claim 1, further comprising at least one position indicator configured to output the ride condition signal, wherein the at least one position indicator is disposed along the ride track.

16. A ride vehicle, comprising:

a ride vehicle base configured to interface with a ride track, wherein the ride vehicle base is configured to move along the ride track;

a ride vehicle controller, wherein the ride vehicle controller is configured to:

receive a locking signal upon the ride vehicle approaching a portion of the ride track associated with a ride condition, and wherein the ride condition is configured to cause the ride vehicle to experience forces above a predetermined threshold;

a movable arm comprising a base end and a free end, the movable arm configured to move along one or more motion-controlled axes, wherein the movable arm is mounted to the ride vehicle base at the base end, and wherein the movable arm is configured to move with respect to the ride vehicle base in response to a movement signal from the ride vehicle controller;

a ride seat attached to the free end of the movable arm; and a locking device configured to actuate, in response to the locking signal, to a locked position to lock movement of the movable arm along at least one motion-controlled axis to restrain the free end of the movable arm.

17. The ride vehicle of claim 16, wherein the ride vehicle controller is configured to determine a location of the ride vehicle along the ride track based at least in part on instructions executable by a processor stored in a memory device and output the locking signal based at least in part on the determined location of the ride vehicle along the ride track.

18. The ride vehicle of claim 16, wherein the ride vehicle controller is configured to determine a location of the ride vehicle based at least in part on a timing system, wherein the controller is configured to output the locking signal at a predetermined time during a ride sequence.

19. The ride vehicle of claim 16, wherein the locking device is configured actuate to an unlocked position to unlock movement of the movable arm along the at least one motion-controlled axis in response to an unlocking signal from the ride vehicle controller.

20. The ride vehicle of claim 16, wherein the ride vehicle controller is configured to receive a ride condition signal from a ride controller and output the locking signal in response to receiving the ride condition signal.

21. A method, comprising:

moving a movable arm of a ride vehicle relative to a ride vehicle base to a first configuration, wherein the movable arm comprises:

a free end; and a base end that is mounted to the ride vehicle base, wherein the ride vehicle base is configured to interface with a ride track;

moving the movable arm from the first configuration to a second configuration when the ride vehicle is at or near a portion of a ride track configured to cause the ride vehicle to experience forces above a predetermined threshold, wherein at least a portion of the movable arm is closer to the ride vehicle base in the second configuration than in the first configuration; and actuating a coupling device or a locking mechanism of the movable arm when the movable arm is positioned in the second configuration to lock or stiffen at least a portion of the movable arm.

* * * * *